US010234103B2

(12) United States Patent
Kwak et al.

(10) Patent No.: US 10,234,103 B2
(45) Date of Patent: Mar. 19, 2019

(54) LIGHTING APPARATUS

(71) Applicant: LG Innotek Co., Ltd., Seoul (KR)

(72) Inventors: Young Kuk Kwak, Seoul (KR); Sang Jun Hong, Seoul (KR); Ji Hoo Kim, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 332 days.

(21) Appl. No.: 15/170,598

(22) Filed: Jun. 1, 2016

(65) Prior Publication Data

US 2016/0290596 A1 Oct. 6, 2016

Related U.S. Application Data

(63) Continuation of application No. 13/610,481, filed on Sep. 11, 2012, now Pat. No. 9,383,066, which is a (Continued)

(30) Foreign Application Priority Data

Nov. 8, 2010 (KR) ..... 10-2010-0110472
Nov. 8, 2010 (KR) ..... 10-2010-0110478

(Continued)

(51) Int. Cl.
*F21V 5/00* (2018.01)
*F21V 7/00* (2006.01)

(Continued)

(52) U.S. Cl.
CPC ..... *F21V 7/0066* (2013.01); *F21K 9/00* (2013.01); *F21K 9/68* (2016.08); *F21V 5/007* (2013.01);

(Continued)

(58) Field of Classification Search
CPC ..... F21Y 2113/13; F21Y 2107/30; F21Y 2103/33; F21Y 2105/18; F21V 15/01; F21V 7/00

(Continued)

(56) References Cited

U.S. PATENT DOCUMENTS 4,480,294 A 10/1984 Carboni
5,136,483 A 8/1992 Schoniger et al.

(Continued)

FOREIGN PATENT DOCUMENTS

CN 1710321 A 12/2005
CN 1936417 3/2007

(Continued)

OTHER PUBLICATIONS

Korean Notice of Allowance for 10-2010-0110562 dated Jul. 30, 2012.

(Continued)

*Primary Examiner* — William J Carter
(74) *Attorney, Agent, or Firm* — Birch, Stewart, Kolasch & Birch, LLP

(57) ABSTRACT

A lighting apparatus comprises: a body comprising a first body and a second body, wherein the first body comprises a first bottom surface and a first side surface, wherein the second body comprises a second bottom surface and a second side surface, and wherein the body has a receiving recess configured by the first bottom surface, the second bottom surface, the first side surface and the second side surface; a reflector disposed in the receiving recess of the body and comprising a plurality of reflective surfaces; and a light source disposed on the first side surface of the first body and the second side surface of the second body, disposed at an area corresponding to the reflective surfaces of the reflector.

20 Claims, 8 Drawing Sheets

Related U.S. Application Data continuation of application No. 13/206,224, filed on Aug. 9, 2011, now Pat. No. 8,382,336.

(30) Foreign Application Priority Data

Nov. 8, 2010 (KR) ..... 10-2010-0110561
Nov. 8, 2010 (KR) ..... 10-2010-0110562
Nov. 8, 2010 (KR) ..... 10-2010-0110563

(51) Int. Cl.

| | |
|---|---|
| ***F21K 9/00*** | (2016.01) |
| ***F21V 29/74*** | (2015.01) |
| ***F21V 7/04*** | (2006.01) |
| ***F21V 17/06*** | (2006.01) |
| ***F21V 23/06*** | (2006.01) |
| ***F21K 9/68*** | (2016.01) |
| *F21V 15/01* | (2006.01) |
| *F21Y 115/10* | (2016.01) |
| *F21Y 113/00* | (2016.01) |

(52) U.S. Cl.
CPC ..... *F21V 7/04* (2013.01); *F21V 7/041* (2013.01); *F21V 17/06* (2013.01); *F21V 23/06* (2013.01); *F21V 29/74* (2015.01); *F21V 15/01* (2013.01); *F21Y 2113/00* (2013.01); *F21Y 2115/10* (2016.08)

(58) Field of Classification Search
USPC ..... 362/234–249.02
See application file for complete search history.

(56) References Cited

U.S. PATENT DOCUMENTS

| | | | | |
|---|---|---|---|---|
| 5,365,411 | A | 11/1994 | Rycroft et al. | |
| 6,409,361 | B1 * | 6/2002 | Ikeda | F21V 19/0025 362/240 |
| 6,478,440 | B1 | 11/2002 | Jaworski et al. | |
| 6,504,301 | B1 | 1/2003 | Lowery | |
| 7,237,927 | B2 | 7/2007 | Coushaine et al. | |
| 2007/0171676 | A1 | 7/2007 | Chang | |
| 2008/0175003 | A1 * | 7/2008 | Tsou | F21V 29/004 362/294 |
| 2008/0217643 | A1 * | 9/2008 | Lin | F21K 9/00 257/99 |
| 2010/0073959 | A1 | 3/2010 | Hamada | |
| 2010/0135010 | A1 * | 6/2010 | Liu | F21V 5/04 362/231 |

FOREIGN PATENT DOCUMENTS

| | | | |
|---|---|---|---|
| CN | 1978979 | | 6/2007 |
| CN | 101180777 | | 5/2008 |
| CN | 201062730 | | 5/2008 |
| CN | 201237173 | | 5/2009 |
| EP | 0416253 | | 3/1991 |
| EP | 1607677 | | 12/2005 |
| EP | 1826474 | | 8/2007 |
| EP | 1944541 | | 7/2008 |
| JP | 2000-268604 | | 9/2000 |
| JP | 2003-059332 | | 2/2003 |
| JP | 2005502904 | A | 1/2005 |
| JP | 2006004935 | | 1/2006 |
| JP | 2006-106212 | | 4/2006 |
| JP | 4211029 | | 11/2008 |
| JP | 2009-117328 | | 5/2009 |
| KR | 1020050089074 | | 9/2005 |
| KR | 1020080012773 | | 2/2008 |
| KR | 1020080073596 | | 8/2008 |
| KR | 1020080098762 | | 11/2008 |
| KR | 20100052121 | A | 5/2010 |
| KR | 1020100092856 | | 8/2010 |
| KR | 1020100117440 | | 11/2010 |
| WO | 03023277 | A1 | 3/2003 |
| WO | 2010/004794 | | 1/2010 |

OTHER PUBLICATIONS

Korean Notice of Allowance for 10-2010-0110563 dated Jul. 30, 2012.
Korean Notice of Allowance for 10-2010-0110472 dated Jul. 30, 2012.
Korean Office Action for 10-2010-0110561.
Korean Office Action for 10-2010-0110562 dated Jan. 27, 2012.
Korean Office Action for 10-2010-0110563 dated Jan. 27, 2012.
European Search Report for 11174196 dated Feb. 8, 2012.
Japanese Office Action for 2011-240787 dated Dec. 17, 2013.
Chinese Office Action for 201110276041 dated Nov. 5, 2013.
Japanese Office Action for application No. 2014-181242 dated May 19, 2015.
European Search Report for application 14156687.7 dated Apr. 16, 2014.

* cited by examiner

LIGHTING APPARATUS

This application is a Continuation Application of U.S. application Ser. No. 13/610,481 file Sep. 11, 2012, which a Continuation Application of U.S. application Ser. No. 13/206,224 filed Aug. 9, 2011, which claims priority from Korean Application Nos. 10-2010-0110472, 10-2010-0110478, 10-2010-0110561, 10-2010-0110562, and 10-2010-0110563, filed Nov. 8, 2010, the subject matters of which are incorporated herein by reference

TECHNICAL FIELD

The present disclosure relates to a lighting apparatus.

BACKGROUND

A light emitting diode (LED) is an energy device for converting electric energy into light energy. Compared with an electric bulb, the LED has higher conversion efficiency, lower power consumption and a longer life span. As there advantages are widely known, more and more attentions are now paid to a lighting apparatus using the LED.

The lighting apparatus using the LED are generally classified into a direct lighting apparatus and an indirect lighting apparatus. The direct lighting apparatus emits light emitted from the LED without changing the path of the light. The indirect lighting apparatus emits light emitted from the LED by changing the path of the light through reflecting means and so on. Compared with the direct lighting apparatus, the indirect lighting apparatus mitigates to some degree the intensified light emitted from the LED and protects the eyes of users.

SUMMARY

One embodiment is a lighting apparatus. The lighting apparatus comprises: a body comprising a first body and a second body, wherein the first body comprises a first bottom surface and a first side surface, wherein the second body comprises a second bottom surface and a second side surface, and wherein the body has a receiving recess configured by the first bottom surface, the second bottom surface, the first side surface and the second side surface; a reflector disposed in the receiving recess of the body and comprising a plurality of reflective surfaces; and a light source disposed on the first side surface of the first body and the second side surface of the second body, disposed at an area corresponding to the reflective surfaces of the reflector.

Another embodiment is a lighting apparatus. The lighting apparatus comprises: a body comprising a bottom surface and a side surface; a reflector disposed on the bottom surface of the body and comprising a first a reflective surface and a second reflective surface; a light source disposed on the side surface of the body, comprising a first light source disposed on the first reflective surface and a second light source disposed on the second reflective surface; and a connection board disposed on the side surface of the body, electrically connecting between the first light source and the second light source.

DETAILED DESCRIPTION OF THE EMBODIMENTS

Figure 1:
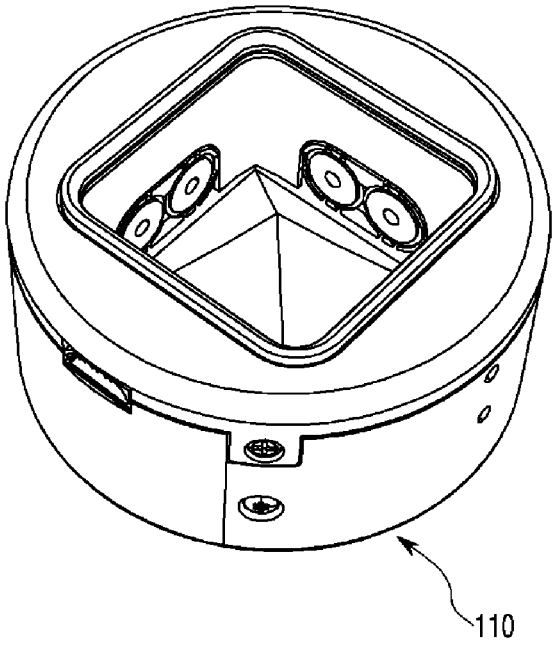
FIG. 1 is a perspective view of a lighting apparatus according to an embodiment of the present disclosure.

In the drawings, a thickness or size of each layer may be magnified, omitted or schematically shown, simply for purpose of convenience and clarity of description. The size of each component may not necessarily represent its actual size.

Further, when an element is referred to as being 'on' or "under" another element, it may be directly on/under the element, or one or more intervening elements may also be present. When an element is referred to as being 'on' or 'under', 'under the element' as well as 'on the element' may be included based on the element.

Hereinafter, an embodiment of the present disclosure will be described in detail with reference to the accompanying drawings.

Figure 2:
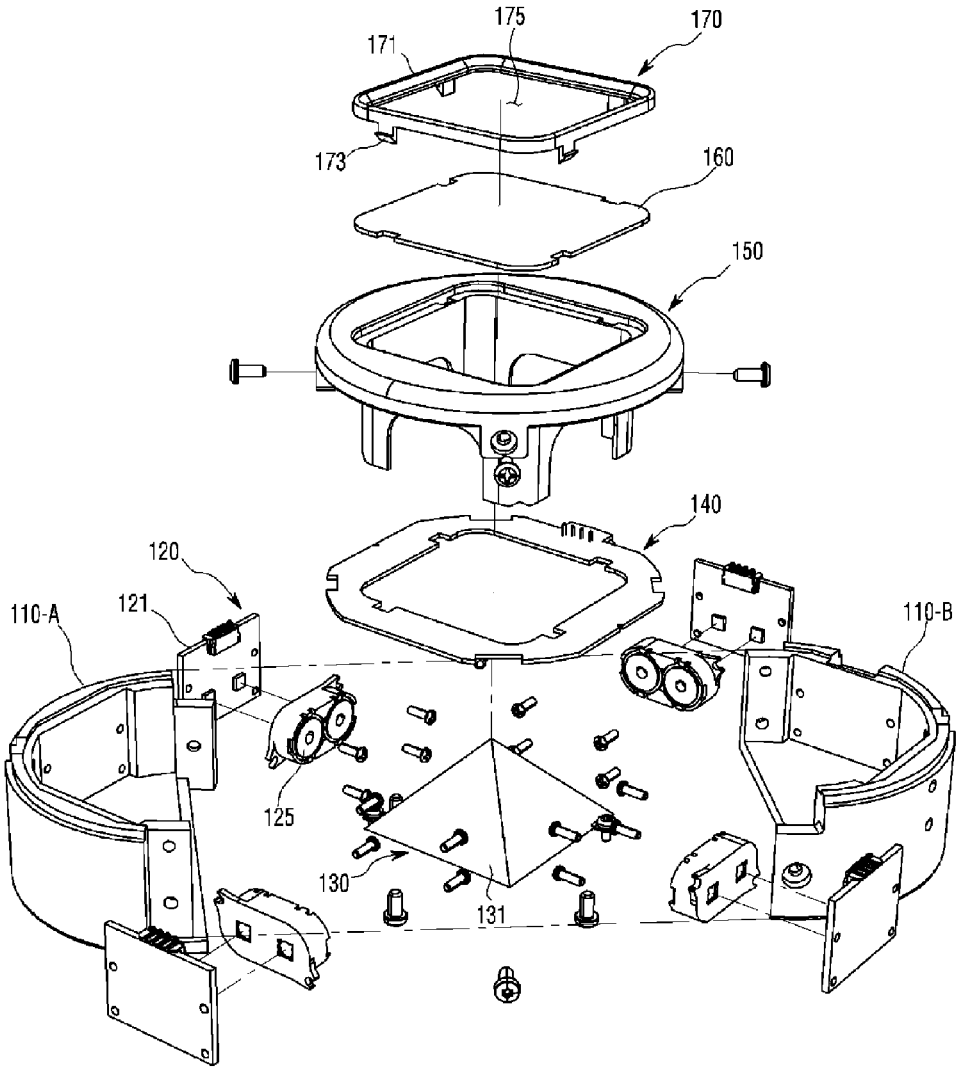
FIG. 2 is an exploded perspective view of the lighting apparatus shown in FIG. 1.

FIG. 1 is a perspective view of a lighting apparatus according to an embodiment of the present disclosure. FIG. 2 is an exploded perspective view of the lighting apparatus shown in FIG. 1.

Referring to FIGS. 1 and 2, a lighting apparatus according to an embodiment of the present disclosure includes a body 110, a light source 120, a reflector 130, a connection board 140, a cover 150, an optic plate 160 and an optic plate holder 170. Hereafter, the components will be described in detail with reference to the drawings.

Figure 3:
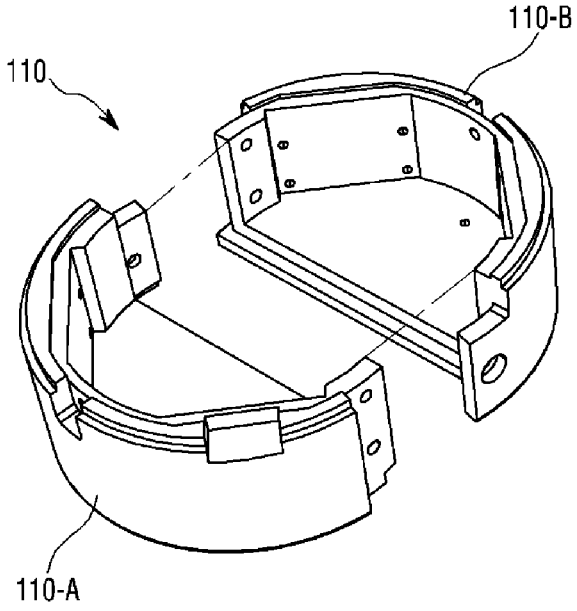
FIG. 3 shows an exploded perspective view and a perspective view of coupling the body of the lighting apparatus shown in FIG. 2.
Figure 3:
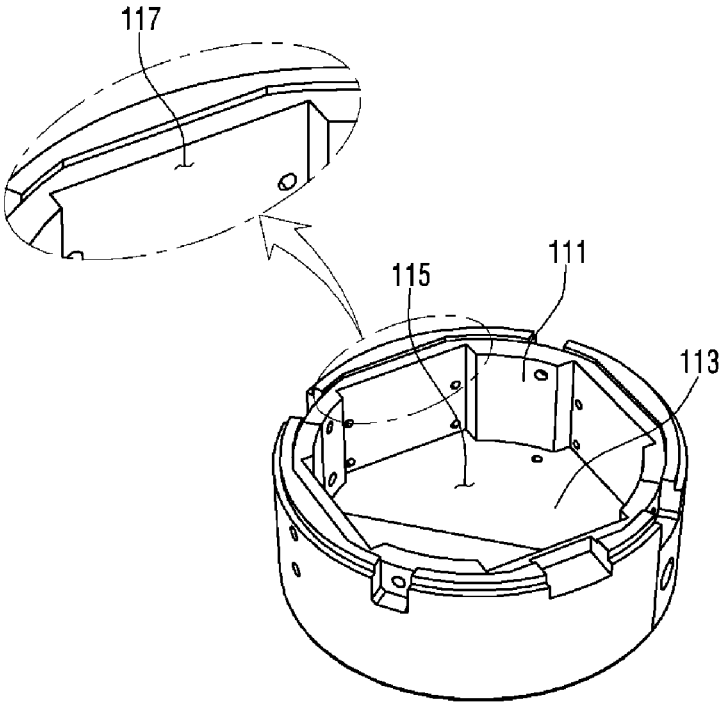

FIG. 3 shows an exploded perspective view and a perspective view of coupling the body of the lighting apparatus shown in FIG. 2.

The body 110 is formed by combining at least two parts. For example, as shown in FIG. 3, the body 110 is formed by combining a first body 110-A with a second body 110-B. Through the combination of the at least two parts, when a lighting apparatus is assembled according to the embodiment of the present disclosure, the light source 120 and the reflector 130 can be easily installed in a receiving recess 115 of the body 110.

The body 110 includes the receiving recess 115 for receiving the light source 120 and the reflector 130. Here, the receiving recess 115 is configured by a side surface 111 and a bottom surface 113. Here, the recess of the receiving recess 115 includes a cavity and a groove.

The side surface 111 of the body 110 is equipped with the light source 120. In more detail, referring to FIG. 2, the side surface 111 of the body 110 comes in surface contact with the one side of a substrate 121 of the light source 120. Since the side surface 111 of the body 110 is equipped with the light source 120, the body 110 can easily receive heat from the light source 120.

The reflector 130 is mounted on the bottom surface 113 of the body 110.

The side surface 111 of the body 110 may be a predeterminedly curved or may not be curved, for example, a polygonal pillar. When the side surface 111 of the body 110 is curved, a portion on which a substrate 121 is placed on the side surface 111 of the body 110 is flat. Otherwise, the side surface 111 of the body 110 includes, as shown in FIG. 3, an mounting recess 117 into which the substrate 121 of the light source 120 is inserted, and the bottom surface of the mounting recess 117 is flat. Since the side surface 111 of the body 110 includes the mounting recess 117, the side surface 111 of the body 110 also comes in surface contact with the lateral surface of the substrate 121 of the light source 120. Therefore, the body 110 can receive more easily the heat from the light source 120. Further, the substrate 121 of the light source 120 can be easily mounted on the inner surface of the body 110. Here, the recess of the mounting recess 117 includes a cavity and a groove.

The body 110 receives the heat from the light source 120 and retains or radiates the heat to the outside. Therefore, it is recommended that the material of the body 110 be a metallic material having thermal conductivity. For example, the body 110 may be made of Al or an alloy including Al.

It is desirable for the body 110 to have a cylindrical shape. However, the body can have various shapes without being limited to this. For example, the body 110 may have a polygonal box shape.

The body 110 may have a heat radiating fin (not shown). The heat radiating fin (not shown) extends outward from the outer surface of the body 110. The body 110 may have a plurality of the heat radiating fins. Otherwise, the heat radiating fin (not shown) may be independent of the body 110 and combined with the body 110. The heat radiating fin (not shown) can more improve the heat radiating effect of the body 110 by increasing the surface area of the body 110.

Figure 4:
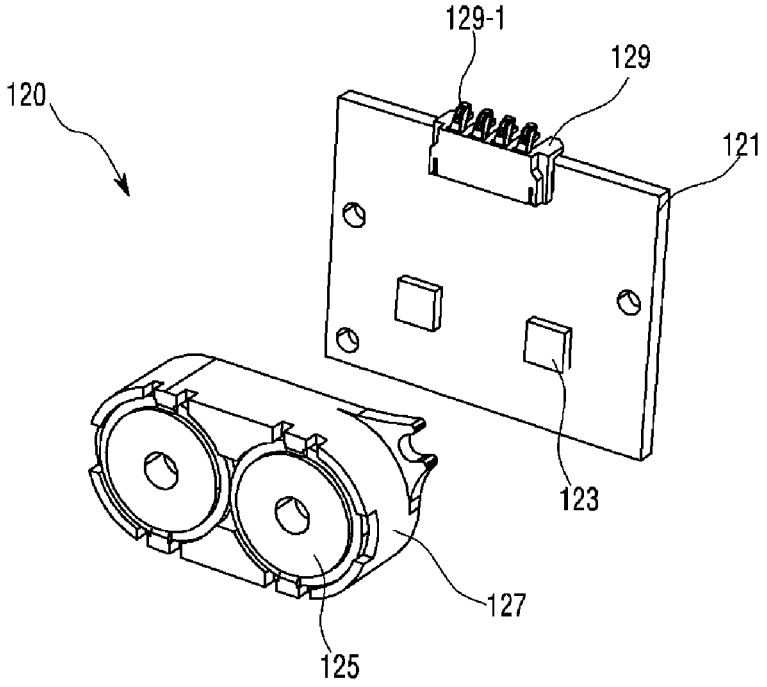
FIG. 4 is an exploded perspective view of the light source of the lighting apparatus shown in FIG. 2.

FIG. 4 is an exploded perspective view of the light source 120 alone of the lighting apparatus shown in FIG. 2.

Referring to FIGS. 2 to 4, the light source 120 is mounted on the side surface 111 of the body 110.

The light source 120 includes the substrate 121, a light emitting diode (LED) 123, a lens 125, a lens holder 127 and a connector 129.

At least one LED 123, the lens 125, the lens holder 127 and the connector 129 are mounted on one side of the substrate 121. The other side of the substrate 121 comes in surface contact with the side surface 111 of the body 110.

The substrate 121 may include a printed circuit pattern for electrically connecting the LED 123 with the connector 129. Therefore, a printed circuit board (PCB) may be used as the substrate 121.

When the substrate 121 is flat and the side surface 111 of the body 110 is curved, the substrate 121 is difficult to come in surface contact with the side surface 111 of the body 110. Therefore, though not shown in the drawings, the substrate 121 may be curved in conformity with the curved the side surface 111 of the body 110.

The LED 123 is a sort of a device emitting light. At least one LED 123 is mounted on the one side of the substrate 121. The LED 123 may have a lateral type or a vertical type. The LED 123 may be at least one of a blue LED, red LED, yellow LED and green LED. Here, the light emitting device is not limited to the LED 123. Any device emitting light like the LED 123 may be used as the light emitting device.

When the LED 123 emits light having a specific color instead of natural light (white light), the LED 123 may further include a fluorescent layer (not shown) having at least one fluorescent material. That is, the fluorescent layer (not shown) surrounding the LED 123 may be further included.

Particularly, when the LED 123 is a blue LED, the fluorescent material included in the fluorescent layer (not shown) includes at least any one selected from a group consisting of a garnet based material (YAG, TAG), a silicate based material, a nitride based material and an oxynitride based material. When the fluorescent layer (not shown) includes a yellow fluorescent material, natural light (white light) can be created. However, it is recommended that a green fluorescent material or a red fluorescent material be further included in the fluorescent layer for the purpose of improving a color rendering index and reducing a color temperature.

When the fluorescent layer (not shown) is mixed with various kinds of the fluorescent materials, the addition ratio of the colors of the fluorescent materials is based on the fact that it is recommended that the green fluorescent material is more used than the red fluorescent material, and the yellow fluorescent material is more used than the green fluorescent material.

The garnet based material (YAG), the silicate based material and the oxynitride based material are used as the yellow fluorescent material. The silicate based material and the oxynitride based material are used as the green fluorescent material. The nitride based material is used as the red fluorescent material.

The fluorescent layer (not shown) may be mixed with various kinds of the fluorescent materials or may be configured by a layer including the red fluorescent material, a layer including the green fluorescent material and a layer including the yellow fluorescent material, which are formed separately from each other.

The lens 125 is mounted on one side of the substrate 121 and covers the LED 123.

The lens 125 decreases the orientation angle of light from the LED 123. That is, the lens 125 collimates the light emitted from the LED 123. A general LED emits light having an orientation angle of approximately 120°. The lens 125 collimates the light emitted from the LED 123 such that the light has an orientation angle of between about 5° and 15°.

The lens 125 is relevant to the reflector 130. Specifically, this matter will be described with reference to FIG. 5.

Figure 5:
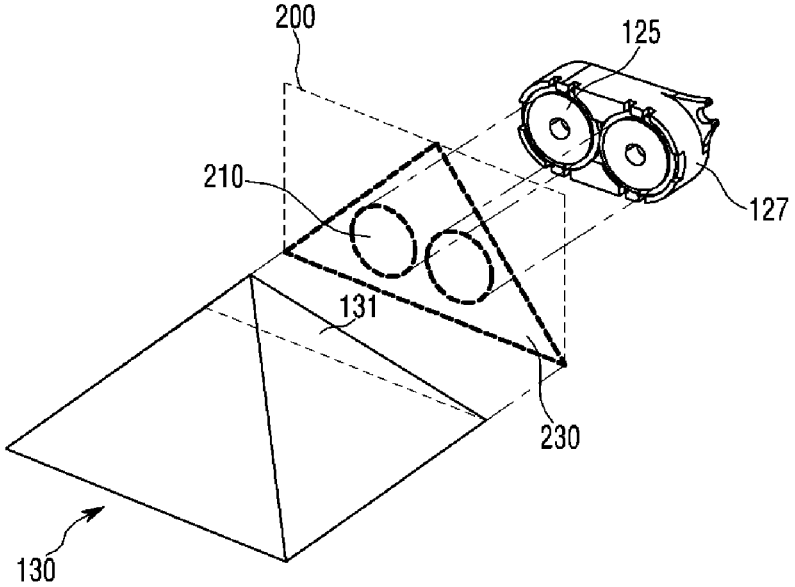
FIG. 5 is a perspective view for describing the relation between the reflector and the lens which are shown in FIG. 2.

FIG. 5 is a perspective view for describing the relation between the reflector 130 and the lens 125 which are shown in FIG. 2.

Referring to FIG. 5, when a predetermined imaginary plane 200 is provided between the reflector 130 and the lens 125 and when the lens 125 and a reflective surface 131 are projected on the imaginary plane 200, a relation between the lens 125 and the reflector 130 can be found.

Specifically, an orthogonal projection 210 of the lens 125, which is formed on the imaginary plane 200, is included in an orthogonal projection 230 of the reflective surface 131, which is formed on the imaginary plane 200. Further, with regard to a plurality of the lenses 125, the orthogonal projections 210 of the total lenses 125 are also included in the orthogonal projection 230 of the reflective surface 131. As such, when the orthogonal projection 210 of the lens 125 is included in the orthogonal projection 230 of the reflective surface 131, all of the light emitted from the lens 125 can mostly reach the reflective surface 131 facing the lens 125.

Therefore, it is possible to improve the luminous efficiency of the lighting apparatus according to the embodiment of the present disclosure.

Referring to FIG. 4 again, the lens 125 includes the aforementioned fluorescent layer (not shown). Both when the LED 123 includes the fluorescent layer (not shown) and when the LED 123 does not, the lens 125 can include the fluorescent layer (not shown). The detailed description of the fluorescent layer (not shown) will be replaced with that of the aforementioned fluorescent layer (not shown).

The lens holder 127 is mounted on one side of the substrate 121 and surrounds and fixes the lens 125. The lens holder 127 securely fixes the lens 125 to the substrate 121.

It is recommended that the lens holder 127 surround at least two lenses 125. When the lens holder 127 integrally surrounds the plurality of the lenses 125, it is possible to reduce the amount of the light lost through the lens 125 and to decrease the intervals among the LEDs 123, thereby reducing the total size of the lighting apparatus.

The connector 129 is disposed on one lateral side of the substrate 121 and includes a projection 129-1 projecting outward from the substrate 121. The projection 129-1 has elasticity acting in an outside direction of the substrate 121. Therefore, when the projection 129-1 is given a predetermined force in an inside direction of the substrate 121, the projection 129-1 is pushed into the inside of the substrate 121. Hereafter, a relation between the connector 129 and the connection board 140 will be described with reference to FIGS. 2, 4 and 7.

Figure 7:
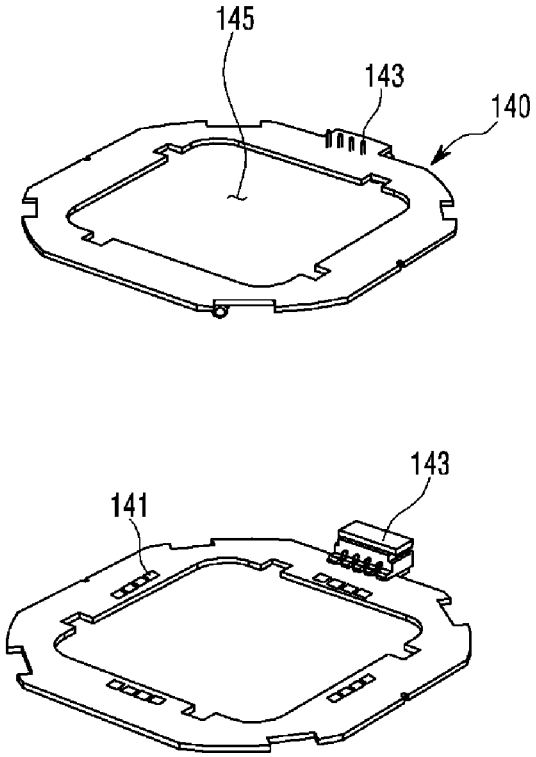
FIG. 7 shows the top and bottom perspective views of the connection board shown in FIG. 2.

When the connection board 140 shown in FIG. 2 is mounted on the body 110, the projection 129-1 is pressed by a pad 141 of the connection board 140 shown in FIG. 7. That is, the connector 129 shown in FIG. 4 is compressed to the pad 141 shown in FIG. 7. Thus, the connector 129 shown in FIG. 4 can be electrically connected to the pad 141 shown in FIG. 7 without a separate wire. A separate wire is not used, so that a manual process such as a soldering, etc., is not required. Besides, it is possible to prevent the luminous efficiency from being degraded due to the wire. Since the inside of the lighting apparatus does not include the wire, the inside can be simply configured.

Referring to FIG. 2, the reflector 130 is mounted on the bottom surface 113 of the receiving recess 115 of the body 110, and reflects in a predetermined direction, particularly, in the upper direction of FIG. 2 light from the light source 120 mounted on the side surface 111 of the body 110.

Figure 6:
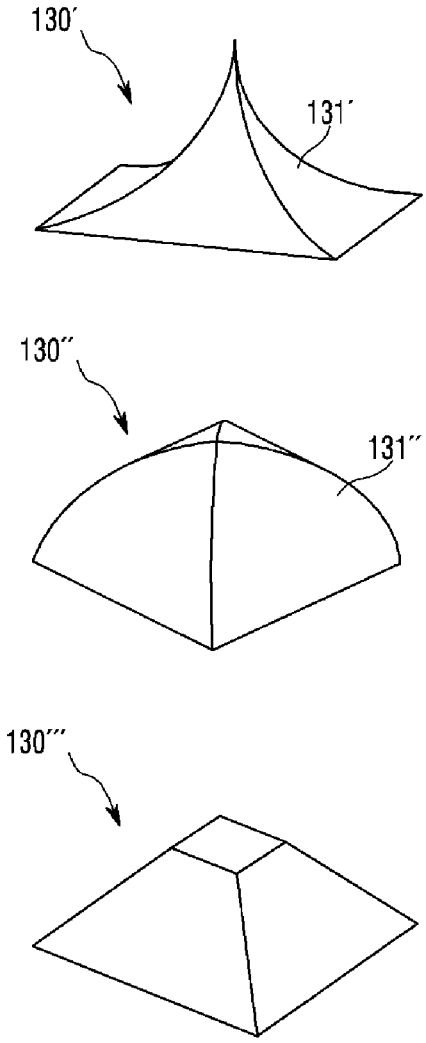
FIG. 6 is a perspective view showing other embodiments of the reflector shown in FIG. 2.

The reflector 130 may have a poly-pyramid shape. Specifically, a detailed description thereof will be provided with reference to FIG. 6. FIG. 6 is a perspective view showing other embodiments of the reflector 130 shown in FIG. 2.

In this application, the poly-pyramid shape includes not only a geometrically perfect quadrangular shape or a geometrically perfect poly-pyramid shape but also a shape in which the reflective surface 131' of a first reflector 130' shown in the top part of FIG. 6 is curved in the inward direction of the poly-pyramid. Further, the poly-pyramid shape includes a shape in which the reflective surface 131" of a second reflector 130" shown in the intermediate part of FIG. 6 is curved in the outward direction of the poly-pyramid. Further, the poly-pyramid shape includes a shape in which a predetermined upper portion of a third reflector 130''' shown in the bottom part of FIG. 6 is removed. The upper portion of the third reflector 130''' shown in the bottom part of FIG. 6 is the same as a shape formed by removing the upper portion of the reflector 130 shown in FIG. 2. Here, the surface of the upper portion of the reflector 130''' may be, as shown, flat or curved.

Referring to FIG. 2 again, the reflector 130 has the reflective surface 131 and a non-reflective surface. The non-reflective surface comes in surface contact with the bottom surface 113 of the body 110. The reflective surface 131 reflects the light from the light source 120 in a predetermined direction.

The reflective surface 131 of the reflector 130 one-to-one corresponds to the light source 120. In other words, the number of the reflective surfaces 131 is equal to the number of the light source 120, and one reflective surface 131 faces one light source 120.

In FIG. 2, since the number of the light sources 120 is four, the reflector 130 has four reflective surfaces 131 in correspondence with the number of the light sources 120. Therefore, the reflector 130 has a quadrangular pyramid shape. In this case, four triangular facets 131 correspond to the reflective surfaces 131, the bottom triangular facet corresponds to the non-reflective surface. Meanwhile, although FIG. 2 shows that the number of the light sources 120 is four and the reflector 130 has a quadrangular pyramid shape, there is no limit to this. The shape of the reflector 130 is changed according to the number of the light sources 120. For example, if the number of the light sources 120 is three, the reflector 130 has a triangular pyramid shape.

The reflective surface 131 of the reflector 130 may be a mirror surface in order to increase the reflectance thereof.

The connection board 140 is connected to the body 110. Specifically, the connection board 140 is connected to cover the receiving recess 115 of the body 110. The detailed description thereof will be provided with reference to FIG. 7.

FIG. 7 shows the top and bottom perspective views of the connection board 140 shown in FIG. 2. The bottom perspective view is obtained by turning the top perspective view upside down.

Referring to FIG. 7, the connection board 140 includes an opening 145 through which light reflected from the reflector 130 passes.

The connection board 140 includes the pad 141 electrically connected to the connector 129 of the light source 120 shown in FIG. 4, and includes a connector 143 receiving electric power from the outside. The pad 141 and the connector 143 are electrically connected with each other through the circuit pattern printed on the connection board 140. That is, the connection board 140 can be a PCB like the substrate 121 of the light source 120. Therefore, the electric power inputted through the connector 143 is transferred to the pad 141, and then the electric power is transferred to the light source 120 because the pad 141 is electrically connected to the connector 129 of the light source 120.

Thanks to the connection board 140, there is no requirement for a separate wire transferring the electric power to the light source 120. Therefore, this makes it possible to simply assemble the lighting apparatus and to prevent the wire from making the internal configuration of the lighting apparatus complex.

The area of the opening 145 of the connection board 140 is greater than that of the non-reflective surface of the reflector 130. Because, if not, the light reflected from the reflector 130 is reflected by the connection board 140, so that the luminous efficiency is degraded.

Figure 8:
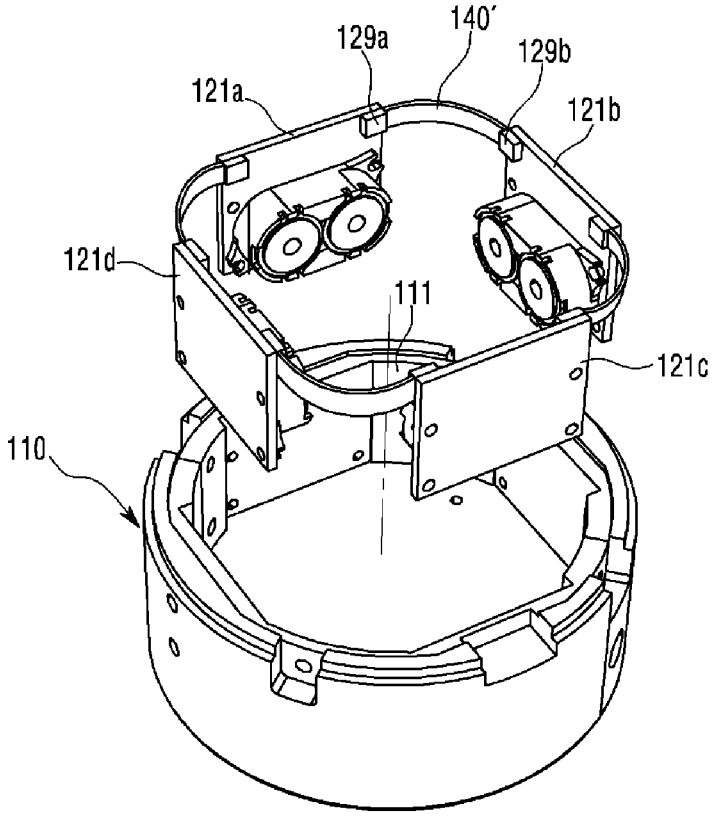
FIG. 8 is an exploded perspective view for describing another embodiment of the connection board of the lighting apparatus shown in FIG. 2.

FIG. 8 is an exploded perspective view for describing another embodiment of the connection board 140 of the lighting apparatus shown in FIG. 2.

Referring to FIG. 8, a connection board 140' electrically connects two adjacent substrates 121*a* and 121*b* with each other. Here, though FIG. 8 shows that the connection board 140' electrically connects the two adjacent substrates 121*a* and 121*b* with each other, there is no limit to this. The connection board 140' can electrically connect two substrates 121*a* and 121*c* or 121*b* and 121*d* which mutually face each other. Further, the connection board 140' can also electrically connect three or more substrates.

When the connection board 140' electrically connects the two adjacent substrates 121*a* and 121*b* with each other, both ends of the connection board 140' are connected with a connector 129*a* of a first substrate 121*a* and a connector 129*b* of a second substrate 121*b*, respectively.

The connection board 140' is disposed to contact with the side surface 111 of the body 110. In this case, it is recommended that the connection board 140' is enclosed with an insulation material so as to insulate the connection board 140' from the body 110. This intends to prevent electrical short-cut between the body 110 and the connection board 140' because the body 110 is usually made of a heat radiating material like Al that is electrically connected. Meanwhile, when the side surface 111 of the body 110 is coated with an insulation material, the connection board 140' is not necessary to be enclosed with the insulation material.

Here, the connection board 140' can be a flexible board that is easily bent. In a case where the side surface 111 of the body 110 is predeterminedly curved or angular, the flexible connection board 140' can easily come in surface contact with the side surface 111 of the body 110.

By using the connection board 140', it is possible to simply assemble the lighting apparatus and to remove a soldering process which uses a separate wire. Moreover, the inside of the lighting apparatus can be simply configured for the lighting apparatus to have its smaller size.

Figure 9:
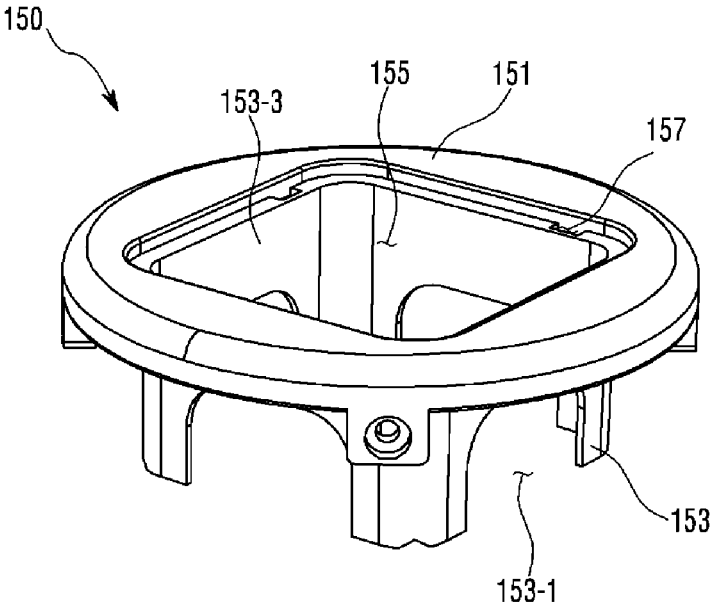
FIG. 9 is a perspective view of the cover of the lighting apparatus shown in FIG. 2.

FIG. 9 is a perspective view of the cover 150 alone of the lighting apparatus shown in FIG. 2.

Referring to FIGS. 2, 4 and 9, the cover 150 includes a support 153 including a coupling recess 153-1 for receiving the lens 125 of the light source 120, surrounding the reflector 130 and being inserted into the receiving recess 115 of the body 110. Here, the recess of the coupling recess 153-1 includes a cavity and a groove.

The detailed example thereof will be described below.

The cover 150 includes a cover part 151, the support 153, an opening 155 and a fastening hole 157.

The cover part 151 covers one side of the body 110 including the receiving recess 115.

The cover part 151 extends from one end of the support 153 in a direction perpendicular to the depth direction of the receiving recess 115 of the body 110. Therefore, the cover part 151 and the body 110 form the appearance of the lighting apparatus according to the embodiment of the present disclosure.

The support 153 is inserted into the receiving recess 115 of the body 110 and comes in contact with the bottom surface 113 of the body 110, and thus supports the entire cover 150. Accordingly, it is recommended that the length of the support 153 be equivalent to the depth of the receiving recess 115 of the body 110.

The support 153 surrounds the reflector 130 mounted in the body 110. Therefore, the support 153 is used as a guide path through which the light reflected from the reflector 130 passes outward. The support 153 prevents the light reflected from the reflector 130 from being lost within the body 110. Accordingly, the luminous efficiency of the lighting apparatus can be improved. Here, an inner surface 153-3 of the support 153 is coated with a reflective material for the purpose of more maximizing the luminous efficiency.

The support 153 includes the coupling recess 153-1 for receiving the lens 125 of the light source 120 at the time of combining the support 153 with the lens 125 of the light source 120. The inner surface 153-3 of the support 153 is placed on the same plane with the light emitting surface (the surface) of the lens 125. When the lens 125 of the light source 120 is inserted into the coupling recess 153-1 of the support 153, a path of the light reflected from the reflector 130 is formed by the inner surface 153-3 of the support 153 and the light emitting surface of the lens 125 of the light source 120. As a result, all of the light reflected from the reflector 130 is reflected by the inner surface 153-3 of the support 153 without being lost within the body 110, so that the light is emitted outward through the opening 155 of the cover 150.

The fastening hole 157 receives and fixes a fastening portion 173 of the optic plate holder 170. The optic plate holder 170 fixes the optic plate 160 to the cover 150 by using the fastening hole 157.

Referring to FIG. 2 again, the optic plate 160 covers the opening 155 of the cover 150 and is disposed on the cover part 151 of the cover 150. The optic plate 160 can optically change the light emitted through the opening 155 of the cover 150. For example, the optic plate 160 can diffuse the light emitted through the opening 155 of the cover 150. The optic plate 160 may include a fluorescent layer (not shown). Here, a description of the fluorescent layer can be replaced with the aforementioned description of the fluorescent layer. Moreover, the optic plate 160 can have all of a diffusion function and the fluorescent layer.

The optic plate holder 170 is fastened to the cover 150 and fixes the optic plate 160. The optic plate holder 170 includes a cover part 171, the fastening portion 173 and an opening 175.

The cover part 171 covers the optic plate 160 and includes the opening 175 through which the light that has passed through the opening 155 of the cover 150 passes.

The fastening portion 173 extends outward from the cover part 171. The fastening portion 173 is inserted and fitted to the fastening hole 157 of the cover 150.

The features, structures and effects and the like described in the embodiments are included in at least one embodiment of the present disclosure and are not necessarily limited to one embodiment. Furthermore, the features, structures and effects and the like provided in each embodiment can be combined or modified in other embodiments by those skilled in the art to which the embodiments belong. Therefore, the contents related to the combination and modification should be construed to be included in the scope of the present disclosure.

The foregoing embodiments and advantages are merely exemplary and are not to be construed as limiting the present disclosure. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A lighting apparatus comprising:

a body comprising a bottom surface and a side surface;

a reflector disposed on the bottom surface of the body and comprising a first a reflective surface and a second reflective surface;

a light source disposed on the side surface of the body, comprising a first light source disposed on the first reflective surface and a second light source disposed on the second reflective surface; and a connection board disposed on the side surface of the body, electrically connecting between the first light source and the second light source, wherein the body has a recess defined by the bottom surface and the side surface, wherein the recess has a cross-section parallel with the bottom surface having a quadrilateral shape before, and wherein the body has a cylindrical outward appearance.

2. The lighting apparatus of claim 1, wherein the first light source comprises a first substrate and a first connector disposed on the first substrate, wherein the second light source comprises a second substrate and a second connector disposed on the second substrate, wherein both ends of the connection board are connected with the first connector and the second connector respectively, and wherein the connection board is disposed to contact with the side surface of the body.

3. The lighting apparatus of claim 1, wherein the connection board is a flexible board, and wherein the connection board is surrounded by an insulation material.

4. The lighting apparatus of claim 1, wherein the body comprises a first body on which the first light source is disposed, and a second body on which the second light source is disposed.

5. The lighting apparatus of claim 1, wherein the first light source comprises a substrate, a light emitting device disposed on the substrate, a lens covering the light emitting device, and a lens holder holding the lens, wherein the body has a recess defined by the bottom surface and the side surface, wherein the lighting apparatus further comprises a cover including a support disposed in the recess of the body and surrounding the reflector, wherein the cover has an opening passing through lights emitted from the lens, and wherein the support has a coupling recess in which the lens holder is disposed.

6. The lighting apparatus of claim 5, wherein the support includes an inner surface reflecting the lights.

7. The lighting apparatus of claim 5, wherein the lens holder holds at least two lenses.

8. The lighting apparatus of claim 1, comprising a heat radiating fin that extends outward from or is connected to the outer surface of the body.

9. A lighting apparatus comprising:

a body comprising a first body and a second body, wherein the first body comprises a first bottom surface and a first side surface, wherein the second body comprises a second bottom surface and a second side surface, and wherein the body has a receiving recess configured by the first bottom surface, the second bottom surface, the first side surface and the second side surface;

a reflector disposed in the receiving recess of the body, disposed on the first bottom surface of the first body and the second bottom surface of the second body, and comprising a plurality of reflective surfaces; and a plurality of light sources comprising a first light source disposed on the first side surface of the first body and a second light source disposed on the second side surface of the second body, disposed at an area corresponding to the reflective surfaces of the reflector, wherein the first body and the second body are separate elements, and the first body is fastened to the second body and the receiving recess extends across a portion of the first body and a portion of the second body.

10. The lighting apparatus of claim 9, wherein the first side surface of the first body and the second side surface of the second body comprise a mounting recess in which the light source is mounted.

11. The lighting apparatus of claim 9, wherein the reflective surfaces of the reflector are curved, or wherein an upper portion of the reflector is flat or curved.

12. The lighting apparatus of claim 9, comprising a heat radiating fin that extends outward from or is connected to the outer surface of the body.

13. The lighting apparatus of claim 9, wherein the light source comprises a substrate, a light emitting device disposed on the substrate and a connector disposed on the substrate, wherein the lighting apparatus includes a connection board which is connected to the body and includes a pad electrically connected to the connector, wherein the connection board coupled to the body at a position above the reflector, the connection board defining an opening through which light generated by the light emitting device and reflected from the reflector passes.

14. The lighting apparatus of claim 13, wherein the connector of the light source comprises a projection having elasticity acting in an outside direction of the substrate, and wherein when the connection board is connected to the body, the projection directly contacts with the pad of the connection board.

15. The lighting apparatus of claim 9, wherein the light source comprises a substrate, a light emitting device disposed on the substrate and a lens disposed on the light emitting device, and wherein an orthogonal projection of the lens, which is formed on an imaginary plane disposed between the reflective surface of the reflector and the lens is included in an orthogonal projection of the reflective surface, which is formed on the imaginary plane.

16. The lighting apparatus of claim 9, wherein each of the light sources comprises a substrate, a light emitting device disposed on the substrate and a lens disposed on the light emitting device, and wherein the lighting apparatus includes a cover including a coupling recess for receiving the lens of the light source, surrounding the reflector and being disposed into the receiving recess of the body.

17. The lighting apparatus of claim 16, wherein the cover includes an inner surface reflecting the lights.

18. The lighting apparatus of claim 16, wherein each of the light sources comprises the lens holder holding at least two lenses.

19. The lighting apparatus of claim 9, wherein the reflector has a poly-pyramid shape, wherein the lighting apparatus further comprises a cover received in the receiving recess, and wherein the cover includes a support guiding each of corners of the reflector.

20. A lighting apparatus comprising:

a body comprising a first body and a second body, wherein the first body comprises a first bottom surface and a first side surface, wherein the second body comprises a second bottom surface and a second side surface, and wherein the body has a receiving recess configured by the first bottom surface, the second bottom surface, the first side surface and the second side surface;

a reflector disposed in the receiving recess of the body, disposed on the first bottom surface of the first body and the second bottom surface of the second body, and comprising a plurality of reflective surfaces; and a plurality of light sources comprising a first light source disposed on the first side surface of the first body and a second light source disposed on the second side surface of the second body, disposed at an area corresponding to the reflective surfaces of the reflector, wherein the light source comprises a substrate, a light emitting device disposed on the substrate and a connector disposed on the substrate, wherein the lighting apparatus includes a connection board which is connected to the body and includes a pad electrically connected to the connector, wherein the connection board coupled to the body at a position above the reflector, the connection board defining an opening through which light generated by the light emitting device and reflected from the reflector passes, and wherein the connector of the light source comprises a projection having elasticity acting in an outside direction of the substrate, and wherein when the connection board is connected to the body, the projection directly contacts with the pad of the connection board.

* * * * *